United States Patent [19]

Bodine

[11] Patent Number: 4,848,486

[45] Date of Patent: Jul. 18, 1989

[54] METHOD AND APPARATUS FOR TRANSVERSELY BORING THE EARTHEN FORMATION SURROUNDING A WELL TO INCREASE THE YIELD THEREOF

[76] Inventor: Albert G. Bodine, 7877 Woodley Ave., Van Nuys, Calif. 91406

[21] Appl. No.: 64,983

[22] Filed: Jun. 19, 1987

[51] Int. Cl.[4] ..... E21B 7/24

[52] U.S. Cl. ..... 175/55; 175/56; 175/61; 175/75; 175/107

[58] Field of Search ..... 175/55, 56, 61, 107, 175/343, 75

[56] References Cited

U.S. PATENT DOCUMENTS

| | | | |
|---|---|---|---|
| 4,384,625 | 5/1983 | Roper et al. | 175/56 |
| 4,527,637 | 7/1985 | Bodine | 175/55 |
| 4,548,281 | 10/1985 | Bodine | 175/55 |
| 4,615,400 | 10/1986 | Bodine | 175/55 |
| 4,667,751 | 5/1987 | Geczy et al. | 175/75 X |

*Primary Examiner*—William P. Neuder

*Attorney, Agent, or Firm*—Edward A. Sokolski

[57] ABSTRACT

A sonic boring tool which employs sonic energy in implementing its boring action is lowered down a well to a region thereof where the flow of effluent is restricted by clogging and contamination. A curved bend is provided in the string above the tool such that the tool is oriented for drilling into the formation laterally from the well. The drill string employed is flexible so that it can follow the curved path of the tool. The tool may comprise a drill bit, sonically driven by means of an orbiting mass oscillator coupled to the drill string or may comprise a hydraulic drilling tool in which hydraulic pulsating jets are generated in response to sonic energy developed in an orbiting mass oscillator and coupled to the tool through a resonantly driven drill string. In one embodiment a rotary table is provided to enable the rotation of the tool in one direction or the other or alternatively in opposite directions to obtain a variety of drilling patterns.

10 Claims, 6 Drawing Sheets

METHOD AND APPARATUS FOR TRANSVERSELY BORING THE EARTHEN FORMATION SURROUNDING A WELL TO INCREASE THE YIELD THEREOF

This invention relates to a method and apparatus for sonically boring transversely of a well to increase the flow of effluent therefrom and more particularly to such a method and apparatus employing a sonic tool which is curved laterally from the drill string on which the tool is suspended.

The earthen formation surrounding a well through the passage of time tends to become contaminated and clogged so that the flow of effluent therefrom becomes restricted. Various techniques have been utilized in the prior art to alleviate this situation such as hydraulic fracturing (HYDRO-FRAC) and the use of sonic energy for fracturing an earthen formation surrounding a well such as described in U.S. Pat. No. 4,471,838.

The present invention involves a method and apparatus for drilling into a formation laterally from the well in a selective manner such as to penetrate desired portions of the formation which may be clogged or contaminated. The method and apparatus of this invention is particularly useful when combined with hydraulic fracturing of the well bore. In such a situation surface pumps are employed for conventional hydraulic fracturing. The lateral convoluted boring accomplished by the method and apparatus of the present invention provides an additional bored area through which the hydraulic fracturing can be extended, the hydraulic fracturing thus working in conjunction with the lateral boring accomplished by means of the present invention.

It is therefore an object of this invention to increase the yield of wells.

It is another object of this invention to provide a sonic lateral boring method and apparatus which can be employed in conjunction with hydraulic fracturing to increase the yield of wells.

Other objects of the invention will become apparent as the description proceeds in connection with the accompanying drawings of which:

Briefly described, the method and apparatus of the invention is as follows. A boring tool which may comprise a sonically driven cutter bit or a hydraulic drive sonic drill is suspended within a well on a flexible drill stem of an elastic material such as steel. A lower portion of the drill stem above the drill is curved so that it angulates transversely away from the longitudinal axis of the main upper portion of the stem. An orbiting mass oscillator is connected to the drill stem and driven at a frequency such as to effect resonant standing wave vibration of the stem typically with the oscillator connected at the top of the stem. The sonic energy so generated causes the drill to drill transversely into the earthen formation surrounding the wall in a curved drilling path dictated by the curvature in the drill stem. This curved drilling path can be made to take various configurations as may be desired by selectively rotating the drill stem in one direction or the other by means of a rotary table or the like.

Figure 1:
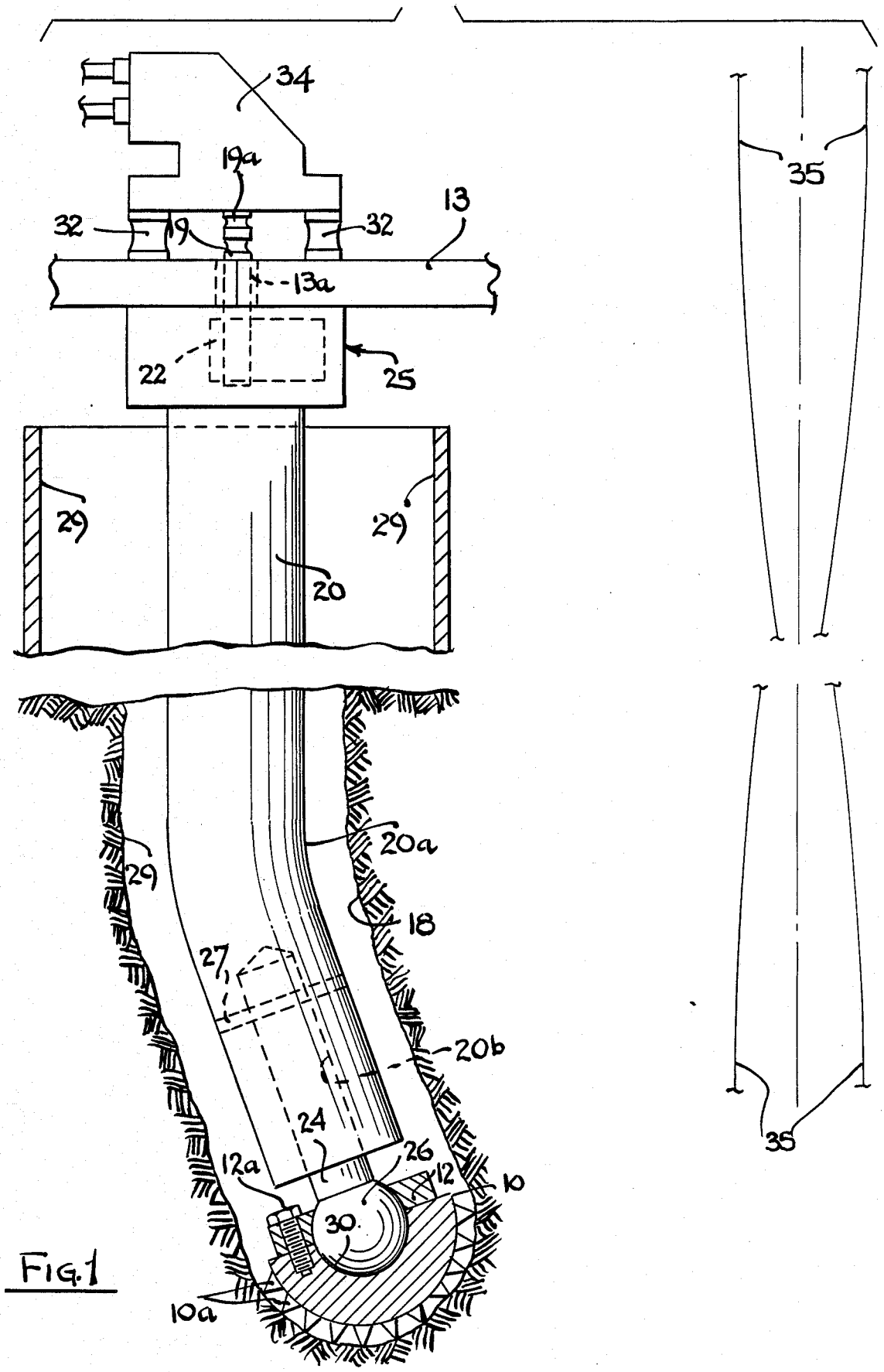
FIG. 1 is a side elevational view of a first embodiment of the invention.

Referring now to FIG. 1 a first embodiment of the invention is illustrated. This embodiment employs the various forms of drilling mechanism of U.S. Pat. No. 4,615,400 issued Oct. 7, 1986, the disclosure of which is incorporated herein by reference and which disclosure will be but briefly set forth herein. One form of the system employs an orbiting mass oscillator 25 which is mounted firmly in energy transmission relationship to the main vibratory drill assembly which comprises flexible drill string 20. The oribiting mass oscillator has a drive shaft 19 which is rotatably mounted in sleeve bearing **13*a* formed in platform 13. Attached to shaft 19 is eccentrically weighted rotor 22. Rotor drive shaft 19 is coupled to a flexible shaft 19*a* which is rotatably driven by motor 34 mounted on platform 13 by means of vibration isolators 32. Drill stem 20 is fabricated of a flexible elastic material such as steel and is fixedly attached to the housing of oscillator 25. Drill bit 10 is in the shape of a hemisphere and has a plurality of cutter teeth 10*a* positioned over the entire outer surface thereof. A spherical ball-socket bearing 30 is formed between the inner spherical surface of cutter bit 10 and ball member 26, the cutter bit having limited universal freedom of motion on bearing 30. The cutter bit is retained to ball member 26 by means of ring-shaped retainer member 12, which has an inner spherical surface, this retainer member being held to bit 10 by means of bolts 12*a*. The bit member 10 is free to turn and move angularly. Ball member 26 is integrally formed with elongated shank member 24, this shank member being pressed firmly into bored out portion 20*b* of drill stem 20 and retained to the drill stem by means of pin member 27. In the portion of the drill stem directly above the drill bit, there is a curved section 20*a* which angulates the bit away from the longitudinal axis of the main upper portion of the drill stem. This curvature typically may be an arc of ten degrees of a circle having a radius of fifty feet (or more for handling casings). For drain hole bores the radius may be less than fifty feet. Table 13** is a rotary table capable of rotating the entire drill assembly such as shown for example in U.S. Pat. No. 2,554,005.

Figure 5:
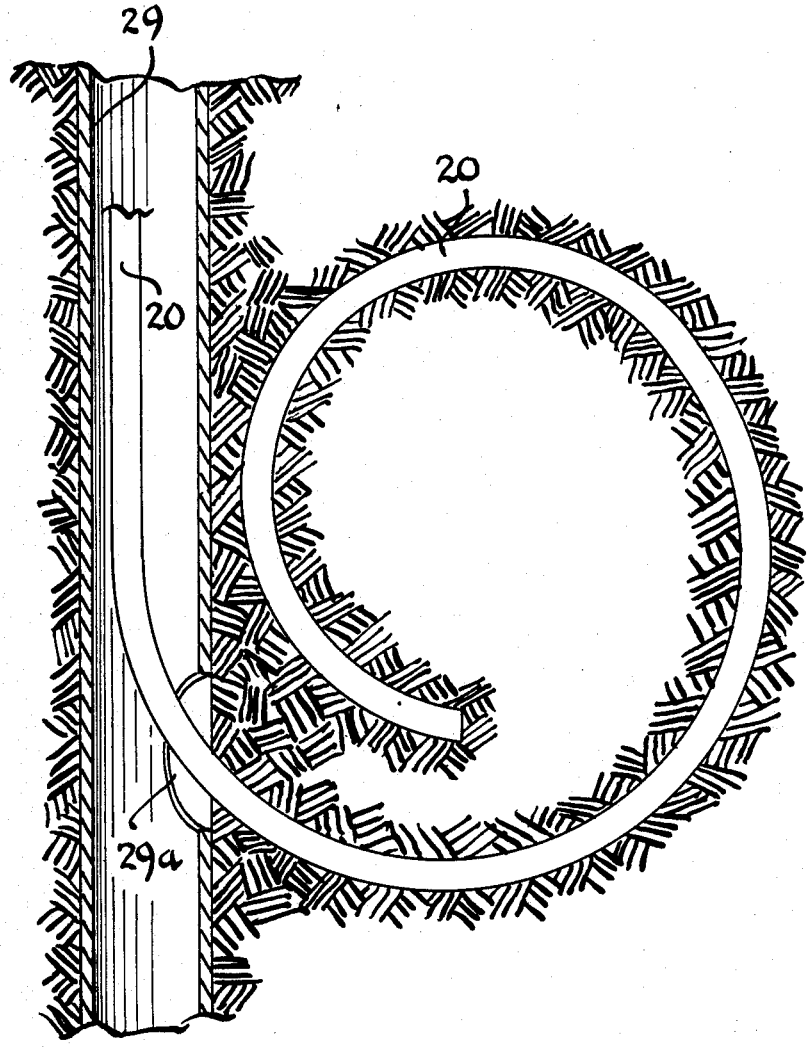
FIG. 5 is a schematic illustration of a first borehole configuration that can be formed with the device of the invention.

When the rotor 22 of oscillator 25 is rotatably driven it generates a cycloidal vibratory sonic force in drill stem 20. Rotor 22 is preferably driven at a frequency such as to set up a resonant standing wave cycloidal vibration in the drill stem, as indicated by graph lines 35. The drilling operation is as described in my aforementioned U.S. Pat. No. 4,615,400 except that in view of the curved section **20*a* in the drill stem, the drilling action will follow a curved path as schematically illustrated in FIG. 5, the drill stem passing through an aperture 29*a* in well casing 29** and following a lateral spiral path, the flexible drill stem bending to follow such path.

Figure 6:
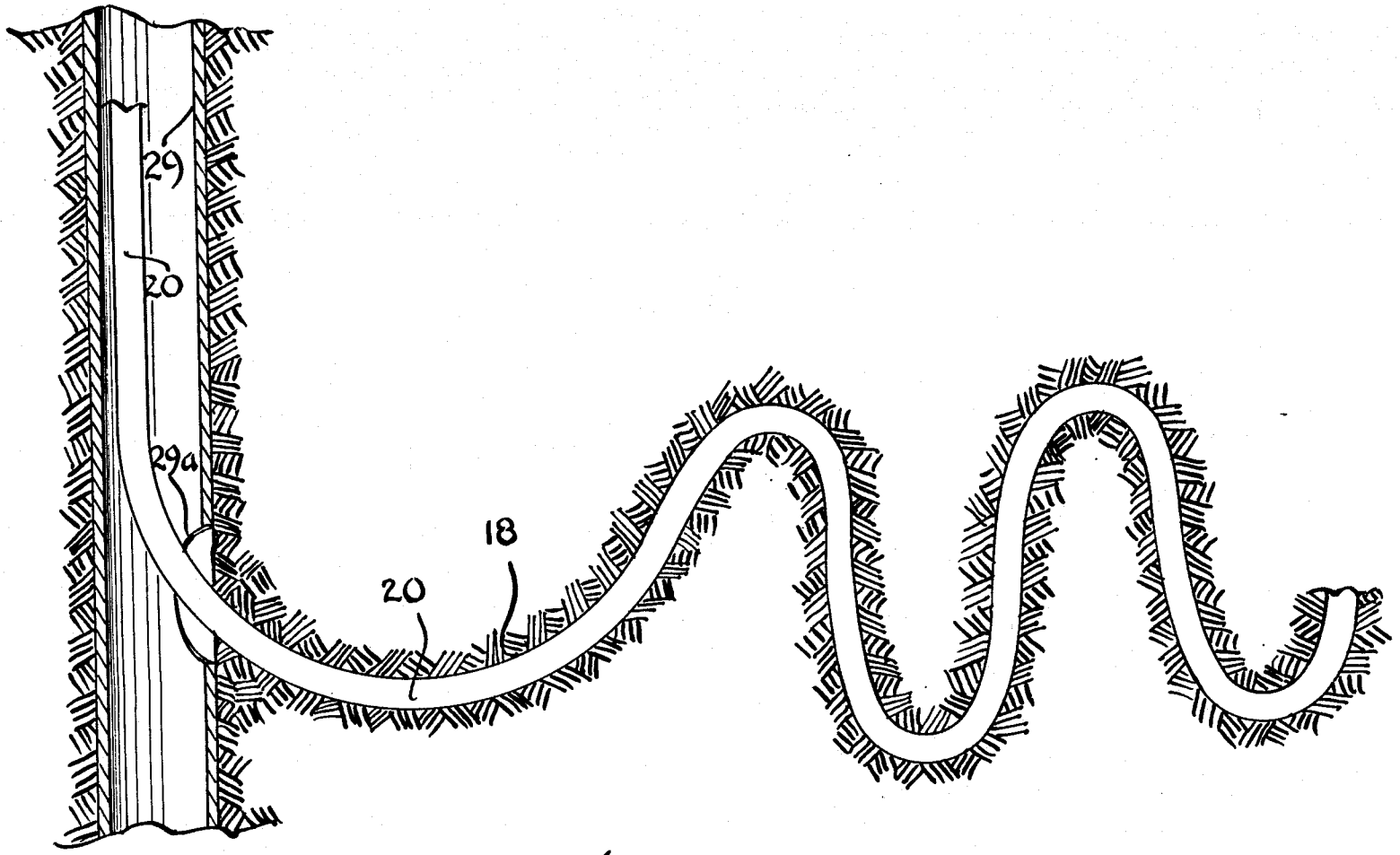
FIG. 6 is a schematic illustration showing a second borehole configuration that can be formed with the device of the invention.
Figure 7:
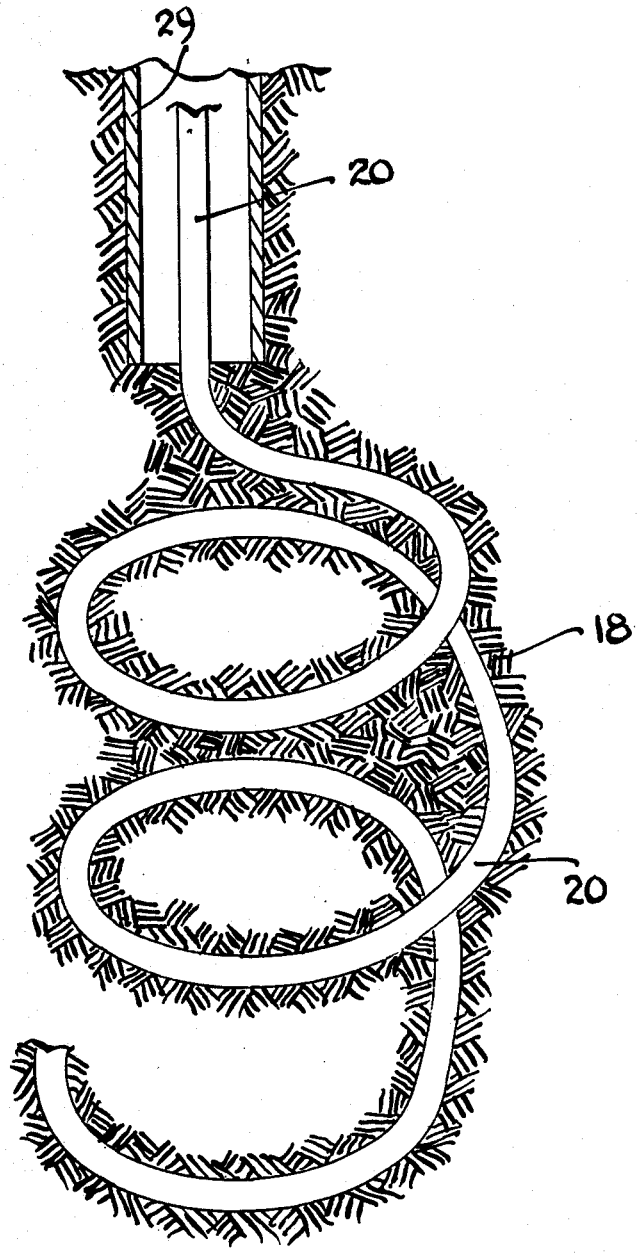
FIG. 7 is a schematic illustration of a third bore hole configuration that can be formed with the device of the invention.

By rotating the drill stem by means of rotary table 13, various bore hole patterns can be formed. For example, a serpentine pattern such as shown in FIG. 6 can be formed by alternately rotating the turn table in opposite directions. A corkscrew pattern such as shown in FIG. 7, can be formed by rotating the turntable continually in the same direction. Hydraulic fracturing may be used in conjunction with the drilling action to fracture the bored out portion of such formation.

Figure 2:
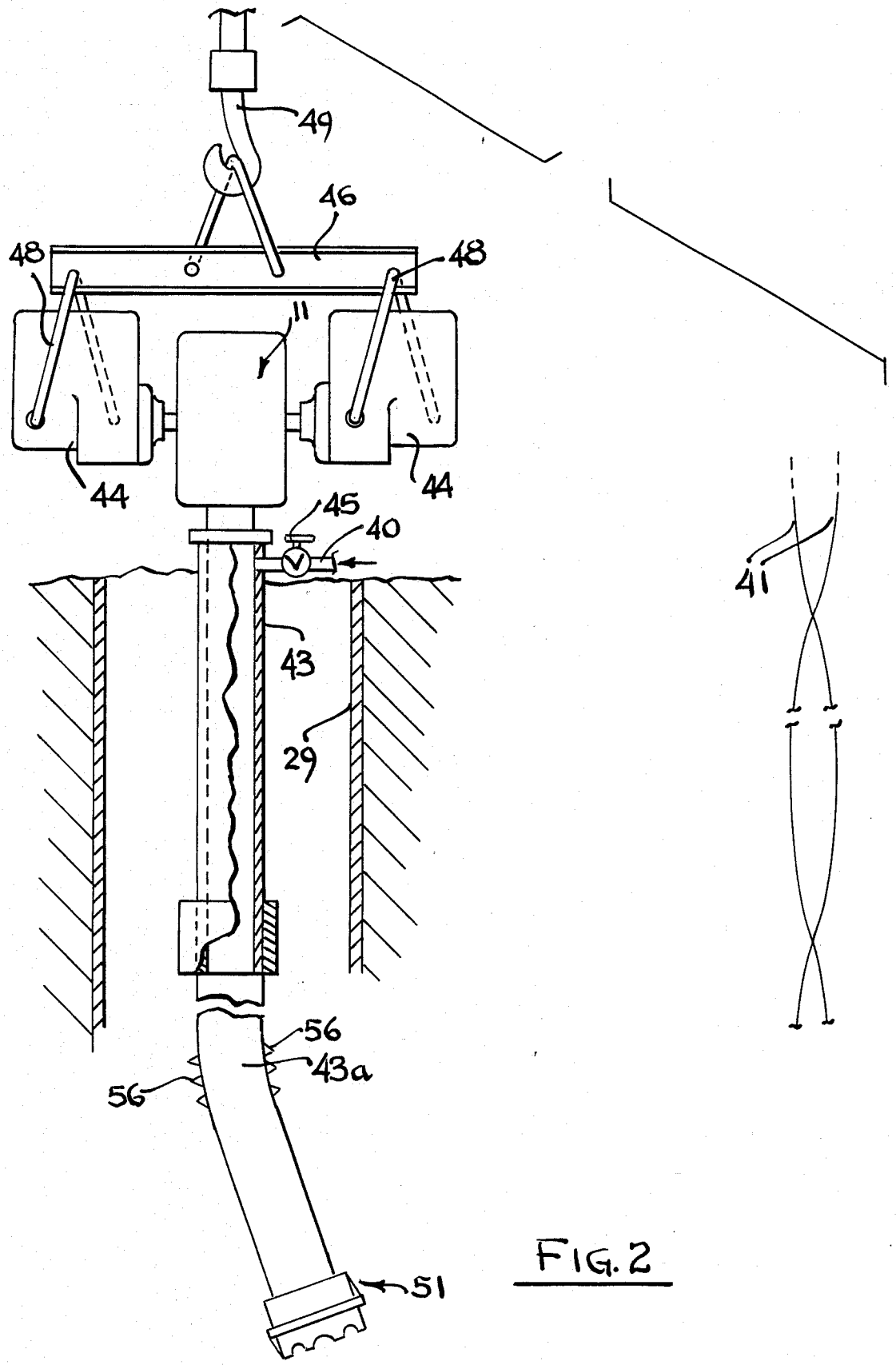
FIG. 2 is a side elevational view of a second embodiment of the invention.

Referring now to FIG. 2, a second embodiment of the invention is illustrated. This embodiment employs the hydraulic driving apparatus described in my U.S. Pat. No. 4,548,281 issued Oct. 22, 1985, the disclosure of which is incorporated herein by reference. In the present instance, however, rather than employing the mechanism for driving a casing into the ground, the device is rather employed as a hydraulic drill. Sonic oscillator 11 comprises orbiting masses formed by paired eccentric rotors which are driven by engines 44 as described in my U.S. Pat. No. 3,189,108. The oscillator-engine assembly is suspended on support beam 46 by means of suspension struts 48, beam 46 in turn being suspended from the hook 49 of a derrick (not shown). Drill stem 43 which is fabricated of a flexible steel is fixedly attached to the casing of oscillator 11. Attached to the bottom end of drill stem 43 is a hydraulic drilling assembly 51 which may be of the type described in connection with FIGS. 3, 3A and 3B of my U.S. Pat. No. 4,548,281.

As in the previous embodiment, a curved section 43*a* is formed in the drill stem above hydraulic drill bit 51, section 43*a* having a curvature as described in the first embodiment and causing the bit to follow a curved path in the same manner as previously described.

In operation, the rotors of oscillators 11 are driven by engines 44 at a speed such as to set up longitudinal elastic standing wave vibration in drill stem 43 as indicated by standing wave graph pattern 41. Liquid is fed into casing 43 from line 40 through valve 45 so as to establish a pressure head at the bottom of the hollow drill stem which may be of the order of several hundred pounds per square inch. The sonic energy will also tend to cause standing wave vibration in the liquid column. The hydraulic drill bit operates as described in my aforementioned '281 patent to displace earthen material by virtue of hydraulic jet action through nozzles contained in drill head 51. The curved well bore may simultaneously be hydraulically fractured by a conventional "hydrofrac" procedure but employing an increased volume of fracturing fluid to accommodate the spirular geometry of the bore.

As for the previous embodiment, the drill stem can be kept stationary to form a spirular bore pattern as shown in FIG. 5 or the stem can be rotated in various manners to produce such patterns as shown in FIGS. 6 and 7.

Figure 4:
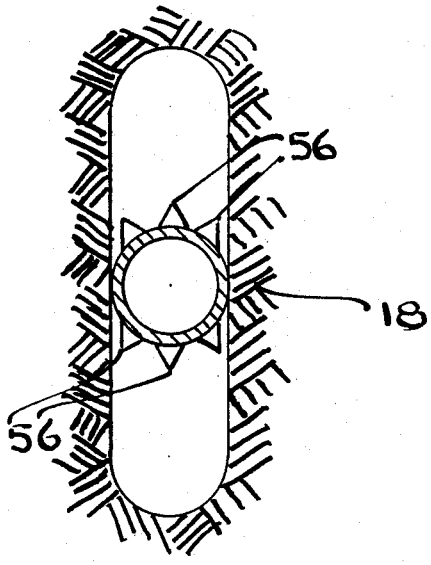
FIG. 4 is a schematic illustration showing the formation of the elongated borehole formed by the embodiment of FIG. 2.

Teeth 56 are formed along diametrically opposite portions of curved drill stem sections 43*a*. These teeth, as shown in FIG. 4 effectively drill out an elliptical borehole in the earthen formation 18 which may be desirable in certain applications.

Figure 3:
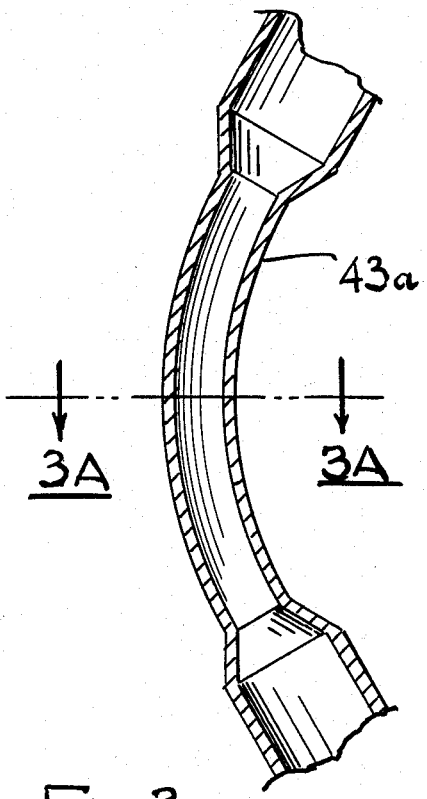
FIG. 3 illustrates a modified form of the curved drill string section which can be utilized in the invention.
Figure 3A:
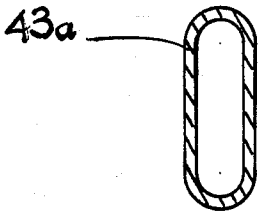
FIG. 3A is a cross sectional view taken along the plane indicated by 3A—3A in FIG. 3.

It may be desirable to flatten the curved drill stem section 43*a* as shown in FIGS. 3 and 3A. This enables the changing of the angle of bend of section 43*a* during the drilling operation by increasing the hydraulic pressure which tends to straighten the tube out. In this manner, the radius of curvature of the borehole path can be changed during the operation, if such be desired.

While the invention has been described and illustrated in detail, it is to be clearly understood that this is intended by way of illustration and example only and is not to be taken by way of limitation, the spirit and scope of the invention being limited only by the terms of the following claims.

I claim:

1. A method for drilling a borehole laterally into an earthen formation surrounding a well comprising the steps of:

lowering a boring tool into the well on a flexible elastic drill stem, said drill stem having an upper straight main portion and a lower curved portion above the tool which causes the tool to angulate transversely away from the longitudinal axis of the main upper portion of the stem, coupling sonic energy to said drill stem to cause the tool to penetrate into said formation in a curved borehole path running substantially transversely of the longitudinal axis of the well, and while the sonic energy is being coupled to the drill stem selectively turning the drill stem to cause the tool to form a borehole path having a predesired pattern.

2. The method of claim 1 wherein the sonic energy is coupled to the drill stem from an orbiting mass oscillator, said oscillator being driven at a frequency such as to effect resonant standing wave vibration of said stem and tool.

3. The method of claim 1 wherein the drill stem is rotated continually in one direction to drill a borehole having a corkscrew pattern.

4. The method of claim 1 wherein the drill stem is alternately rotated in opposite directions to drill a borehole having a serpentine pattern.

5. The method of claim 1 wherein the boring tool is hydraulic and liquid is fed thereto to effect pulsating hydraulic boring action in response to the sonic energy.

6. The method of claim 1 wherein cutter teeth are formed on diametrically opposite sides of the outer wall of the curved portion of said stem, said teeth engaging the borehole wall so as to laterally widen the borehole.

7. The method of claim 1 including employing hydraulic power to drive a sonic oscillator which actuates a cutting bit action at the lower end of said stem.

8. A method for drilling a borehole laterally into an earthen formation surrounding a well comprising the steps of:

lowering a boring tool into the well on a flexible elastic drill stem, said drill stem having an upper straight main portion and a lower curved portion above the tool which causes the tool to angulate transversely away from the longitudinal axis of the main upper portion of the stem, coupling sonic energy to said drill stem to cause the tool to penetrate into said formation in a curved borehole path running substantially transversely of the longitudinal axis of the well, and pumping hydraulic fluid into the well to hydraulically fracture the portions of the earthen formation penetrated by the tool.

9. A method for drilling a borehole laterally into an earthen formation surrounding a well comprising the steps of:

lowering a hydraulic boring tool into the well on a flexible elastic drill stem, said drill stem having an upper straight main portion and a lower curved flattened portion above the tool which causes the tool to angulate transversely away from the longitudinal axis of the main upper portion of the stem, coupling sonic energy to said drill stem to cause the tool to penetrate into said formation in a curved borehole path running substantially transversely of the longitudinal axis of the well, feeding liquid to the boring tool thereby effecting pulsating hydraulic boring action in response to the sonic energy, and selectively increasing the hydraulic pressure of the liquid to lessen the degree of curvature of the curved portion of the drill stem thereby changing the radius of curvature of the borehole path.

10. A system for use in drilling a borehole laterally into an earthen formation surrounding a well comprising:

a drill stem of a flexible elastic material, a boring tool attached to one end of said drill stem, said drill stem having a main upper straight portion and a lower curved portion above the tool, cutter teeth formed on diametrically opposite portions of the outer wall of the curved portion of said stem, means for suspending said tool in said well from said drill stem, an orbiting mass oscillator coupled to said drill stem, and means for driving said oscillator so as to cause the tool to vibrate at a sonic frequency, whereby the tool penetrates into said formation to form a curved borehole running substantially transversely of the longitudinal axis of the well, said cutter teeth operating to laterally elongate the borehole.

* * * * *